US010597048B2

(12) United States Patent
Kato et al.

(10) Patent No.: US 10,597,048 B2
(45) Date of Patent: Mar. 24, 2020

(54) CARBODY OF RAILCAR

(71) Applicant: KAWASAKI JUKOGYO KABUSHIKI KAISHA, Kobe-shi, Hyogo (JP)

(72) Inventors: Eiichi Kato, Kobe (JP); Tsunetoshi Goto, Kobe (JP); Shinichi Miura, Kobe (JP); Kouichi Tsunoda, Kobe (JP); Taimei Suga, Kobe (JP); Ryo Uehara, Kobe (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 297 days.

(21) Appl. No.: 15/524,831

(22) PCT Filed: Sep. 29, 2015

(86) PCT No.: PCT/JP2015/004956

§ 371 (c)(1),
(2) Date: May 5, 2017

(87) PCT Pub. No.: WO2016/072043

PCT Pub. Date: May 12, 2016

(65) Prior Publication Data

US 2017/0320503 A1 Nov. 9, 2017

(30) Foreign Application Priority Data

Nov. 5, 2014 (JP) ..... 2014-224948

(51) Int. Cl.
*B61D 17/04* (2006.01)
*B61D 17/12* (2006.01)
(Continued)

(52) U.S. Cl.
CPC ..... *B61D 17/045* (2013.01); *B61D 17/048* (2013.01); *B61D 17/12* (2013.01);
(Continued)

(58) Field of Classification Search
CPC ..... B61D 3/00; B61D 17/00; B61D 17/04; B61D 17/043; B61D 17/045; B61D 17/12
See application file for complete search history.

(56) References Cited

U.S. PATENT DOCUMENTS 4,570,545 A 2/1986 Sherrow
5,365,662 A 11/1994 Anderegg

FOREIGN PATENT DOCUMENTS

CN 201712615 U 1/2011
CN 102913520 A 2/2013
(Continued)

OTHER PUBLICATIONS

Dec. 22, 2015 Search Report issued in International Patent Application No. PCT/JP2015/004956.
(Continued)

*Primary Examiner* — Robert J McCarry, Jr.
(74) *Attorney, Agent, or Firm* — Oliff PLC

(57) ABSTRACT

A carbody of a railcar includes: a roof bodyshell; a supporting body provided under the roof bodyshell, the supporting body being attached to the roof bodyshell in a state of being positioned in the vertical direction; a rotating body which is threadedly engaged with the supporting body and rotates relative to the supporting body about an axis extending in a vertical direction to be displaced relative to the supporting body in the vertical direction; and a support target member supported by the roof bodyshell through the supporting body and the rotating body, the support target member being attached to the rotating body in a state of being positioned in the vertical direction, a vertical distance between the roof bodyshell and the support target member being adjustable by displacement of the rotating body relative to the supporting body.

4 Claims, 7 Drawing Sheets

(51) Int. Cl.

| | |
|---|---|
| ***B61D 37/00*** | (2006.01) |
| ***B61D 17/18*** | (2006.01) |
| ***B61F 5/18*** | (2006.01) |
| *B61F 1/14* | (2006.01) |

(52) U.S. Cl.
CPC ..... *B61D 17/18* (2013.01); *B61D 37/00* (2013.01); *B61F 5/18* (2013.01); *B61F 1/14* (2013.01)

(56) References Cited

FOREIGN PATENT DOCUMENTS

| | | | | |
|---|---|---|---|---|
| JP | 2012-126185 | A | 7/2012 | |
| NO | 300203 | B1 | 4/1997 | |
| WO | 2012-137706 | A1 | 10/2012 | |
| WO | WO-2012137706 | A1 * | 10/2012 | ..... B61D 17/12 |

OTHER PUBLICATIONS

Dec. 22, 2015 Written Opinion issued in International Patent Application No. PCT/JP2015/004956.

* cited by examiner

CARBODY OF RAILCAR

TECHNICAL FIELD

The present invention relates to a carbody of a railcar.

BACKGROUND ART

In a carbody of a railcar, a passenger room where passengers stay is formed by attaching interior materials to a structure produced by joining metals to one another by welding. The structure is produced while giving priority to strength and the like for the purpose of withstanding loads generated by movements, braking, and the like of the railcar. On the other hand, since the interior materials are seen by the passengers, appearances thereof need to be kept. Since the structure is assembled by welding, manufacturing tolerance is set to be large. However, regarding the interior materials, even a small level difference is conspicuous, so that the appearances thereof cannot be kept. Therefore, liners are stacked on and adhere to an attachment surface of the structure, the interior materials being attached to the attachment surface, and with this, the attachment positions of the interior materials are adjusted. Thus, the interior materials are attached to a flat surface with no level difference in the entire railcar. Further, PTL 1 discloses that: a first metal fitting is attached to a roof bodyshell; a second metal fitting is attached to the first metal fitting by a bolt while adjusting the position of the second meal fitting in a vertical direction; and a support target member (for example, a lightning appliance or a hanger rod receiver) is attached to the second metal fitting.

CITATION LIST

Patent Literature

PTL 1: Japanese Laid-Open Patent Application Publication No. 2012-126185

SUMMARY OF INVENTION

Technical Problem

However, this method using the liners depends on the technique of a worker, and adjustment work takes time. Further, according to the method of PTL 1, since the second metal fitting is attached to the first metal fitting by the bolt, positioning of the first metal fitting and the second metal fitting in the vertical direction depends on axial force of the bolt. When a load acting on the support target member in the vertical direction is high, strength of attachment of the second metal fitting to the first metal fitting needs to be improved.

An object of the present invention is to provide a carbody of a railcar, the carbody being capable of stably determining a vertical distance between a roof bodyshell and a support target member without requiring work skills, and obtaining strength of the carbody.

Solution to Problem

A carbody of a railcar according to one aspect of the present invention includes: a roof bodyshell; a supporting body provided under the roof bodyshell, the supporting body being attached to the roof bodyshell in a state of being positioned in the vertical direction; a rotating body which is threadedly engaged with the supporting body and rotates relative to the supporting body about an axis extending in a vertical direction to be displaced relative to the supporting body in the vertical direction; and a support target member supported by the roof bodyshell through the supporting body and the rotating body, the support target member being attached to the rotating body in a state of being positioned in the vertical direction, a vertical distance between the roof bodyshell and the support target member being adjustable by displacement of the rotating body relative to the supporting body and the roof bodyshell.

A carbody of a railcar according to another aspect of the present invention includes: a roof bodyshell; a supporting body provided under the roof bodyshell; a rotating body which is threadedly engaged with the supporting body and rotates relative to the supporting body about an axis extending in a vertical direction to be displaced relative to the supporting body in the vertical direction, the rotating body being attached to the roof bodyshell in a state of being positioned in the vertical direction; and a support target member supported by the roof bodyshell through the supporting body and the rotating body, the support target member being attached to the supporting body in a state of being positioned in the vertical direction, a vertical distance between the roof bodyshell and the support target member being adjustable by displacement of the supporting body relative to the rotating body.

According to the above respective configurations, the rotating body is threadedly engaged with the supporting body. Only by rotating the rotating body relative to the supporting body, the supporting body and the rotating body can be displaced relative to each other in the vertical direction. Therefore, the vertical distance between the roof bodyshell and the support target member can be adjusted by such simple work. As long as the supporting body and the rotating body are not rotated relative to each other, relative positions of the supporting body and the rotating body in the vertical direction do not change. Therefore, the vertical distance between the roof bodyshell and the support target member can be stably determined. Further, since the rotating body is threadedly engaged with the supporting body so as to rotate relative to the supporting body about the axis extending in the vertical direction, strength with respect to load acting in the vertical direction is satisfactory.

Advantageous Effects of Invention

The present invention can provide a carbody of a railcar, the carbody being capable of stably determining a vertical distance between a roof bodyshell and a support target member without requiring work skills, and obtaining strength of the carbody.

DESCRIPTION OF EMBODIMENTS

Hereinafter, embodiments will be explained in reference to the drawings.

Embodiment 1

Figure 1A:
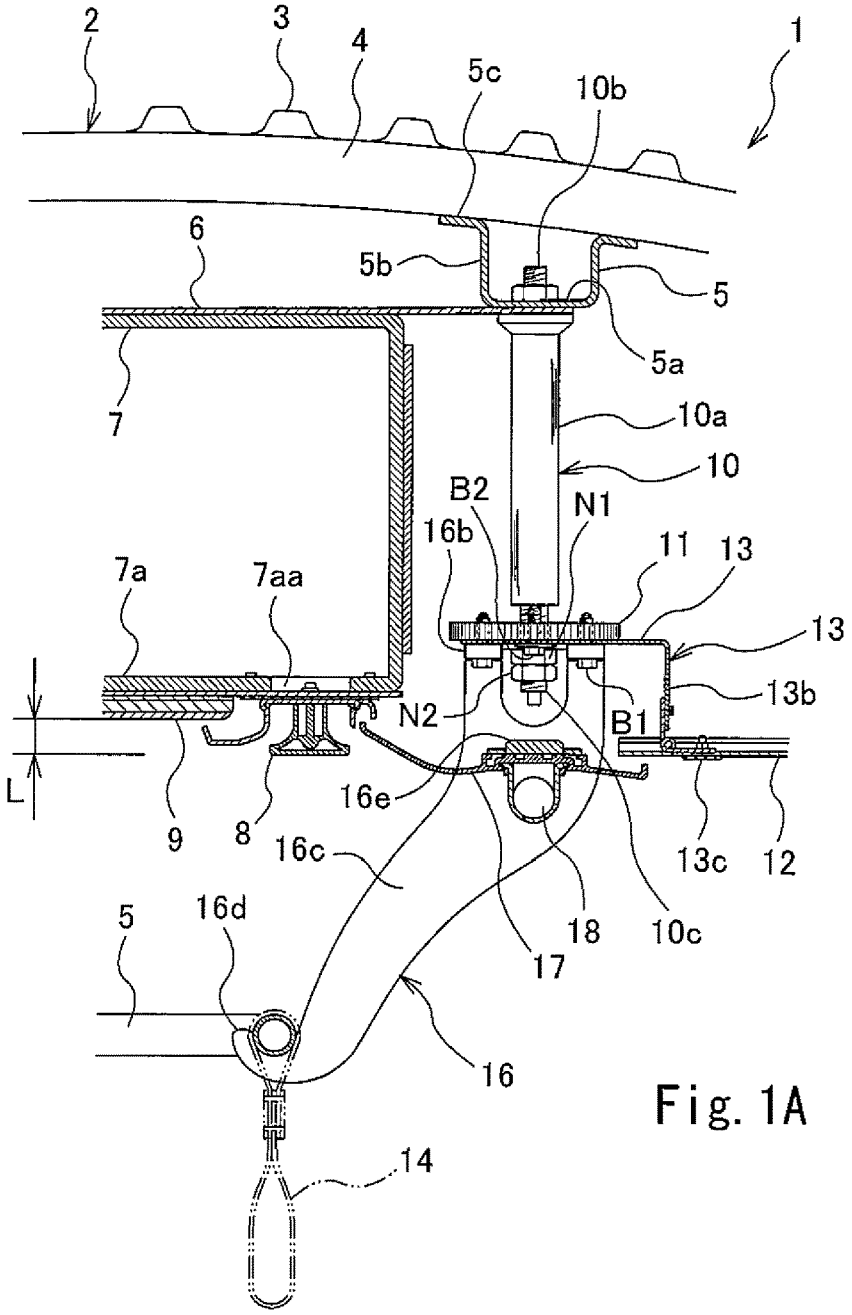
FIG. 1A is a major component sectional view showing a carbody of a railcar according to Embodiment 1.
Figure 1B:
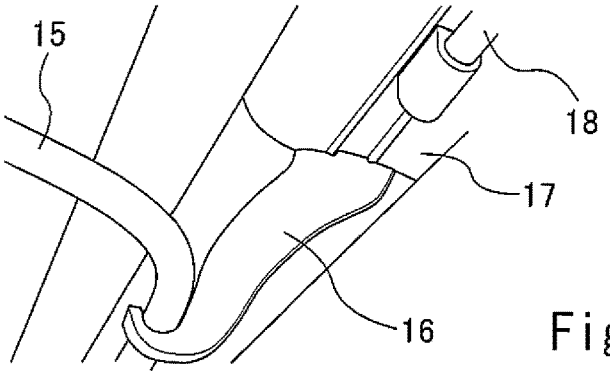
FIG. 1B is an enlarged perspective view showing a part of the carbody of FIG. 1A when viewed from below.

FIG. 1A is a major component sectional view showing a carbody 1 of a railcar according to Embodiment 1. FIG. 1B is an enlarged perspective view showing a part of the carbody 1 of FIG. 1A when viewed from below. As shown in FIGS. 1A and 1B, the carbody 1 of the railcar of the present embodiment includes a roof bodyshell 2. The roof bodyshell 2 includes a circular-arc corrugated plate 3 and a plurality of carlines 4. The corrugated plate 3 is convex upward when viewed from a railcar longitudinal direction (hereinafter may also be referred to as a rail direction or a forward/rearward direction). The plurality of carlines 4 are fixed to a lower surface of the corrugated plate 3, extends in a railcar width direction (hereinafter may also be referred to as a sleeper direction or a crosswise direction), and are arranged at intervals in the railcar longitudinal direction. A first reinforcing member 5 extending in the railcar longitudinal direction is fixed to lower surfaces of the carlines 4. The first reinforcing member 5 includes: a horizontal bottom wall portion 5*a*; a pair of side wall portions 5*b* projecting upward from both respective railcar width direction ends of the bottom wall portion 5*a*; and flange portions 5*c* projecting from respective upper ends of the side wall portions 5*b* in directions away from each other. Circular holes each having a complete round shape are formed at the bottom wall portion 5*a* of the first reinforcing member 5 at intervals in the railcar longitudinal direction. Nuts communicating with the respective circular holes are welded to an upper surface of the bottom wall portion 5*a*. It should be noted that internal threads may be formed on inner peripheral surfaces of the circular holes.

Supporting rods 10 (supporting bodies) provided under the roof bodyshell 2 are fixed to the first reinforcing member 5. Each of the supporting rods 10 has an axis extending in a vertical direction. Specifically, a below-described upper end portion 10*b* of the supporting rod 10 is threadedly engaged with the circular hole of the first reinforcing member 5. A second reinforcing member 6 having a frame plate shape is sandwiched between the supporting rod 10 and the first reinforcing member 5. To be specific, the first reinforcing member 5 and the second reinforcing member 6 are fastened together by the supporting rod 10. An air conditioning duct 7 located at a middle in the railcar width direction is fixed to the second reinforcing member 6. A ventilation hole 7*aa* is formed at a railcar width direction end portion of a lower wall portion 7*a* of the air conditioning duct 7. A guide member 8 configured to guide wind flowing out from the ventilation hole 7*a* is attached to the lower wall portion 7*a* of the air conditioning duct 7. A middle ceiling plate 9 is attached to a middle portion of a lower surface of the lower wall portion 7*a* of the air conditioning duct 7, the middle portion being not covered with the guide member 8. A space under the middle ceiling plate 9 is a passenger room where passengers stay.

The supporting rod 10 includes: a columnar rod main body portion 10*a*; the upper end portion 10*b* provided at an upper side of the rod main body portion 10*a*; and a lower end portion 10*c* provided at a lower side of the rod main body portion 10*a*. The upper end portion 10*b* is an upper external thread portion that is smaller in diameter than the rod main body portion 10*a* and projects upward from the rod main body portion 10*a*. The lower end portion 10*c* is a lower external thread portion that is smaller in diameter than the rod main body portion 10*a* and projects downward from the rod main body portion 10*a*. The upper end portion 10*b* of the supporting rod 10 is threadedly engaged with the bottom wall portion 5*a* of the first reinforcing member 5. By threadedly engaging the upper end portion 10*b* with the first reinforcing member 5 as above, the supporting rod 10 is attached to the roof bodyshell 2 so as to be positioned in the vertical direction and a horizontal direction. A rotating body 11 having a circular plate shape is threadedly engaged with the lower end portion 10*c* of the supporting rod 10 so as to be rotatable. Specifically, a middle internal thread hole 11*a* (see FIG. 2B) having an axis extending in the vertical direction is formed at a center of the rotating body 11, and the middle internal thread hole 11*a* is threadedly engaged with the lower end portion 10*c*. To be specific, by rotating the rotating body 11 relative to the supporting rod 10 about the axis extending in the vertical direction, the rotating body 11 is displaced relative to the supporting rod 10 in the vertical direction. Roughness (for example, knurling) is formed on an outer peripheral surface of the rotating body 11 so as to allow a worker to easily rotate the rotating body 11 by hand.

A side ceiling plate bracket 13 (support target member) fixed to a side ceiling plate 12 is attached to the rotating body 11. To be specific, the side ceiling plate bracket 13 is supported by the roof bodyshell 2 through the supporting rod 10 and the rotating body 11. The side ceiling plate 12 is located away from the middle ceiling plate 9 and the guide member 8 outward in the railcar width direction and is arranged outside the supporting rod 10 in the railcar width direction and under the supporting rod 10. It is desirable that a vertical position (height position) of a lower surface of the side ceiling plate 12 coincide with a vertical position (height position) of a lower surface of the middle ceiling plate 9. The vertical position of the lower surface of the side ceiling plate 12 and the vertical position of the lower surface of the middle ceiling plate 9 need to be adjusted to reduce a displacement length L between the vertical position of the lower surface of the side ceiling plate 12 and the vertical position of the lower surface of the middle ceiling plate 9.

The side ceiling plate bracket 13 includes: a horizontal upper wall portion 13*a*; a side wall portion 13*b* hanging down from a railcar width direction outer end portion of the upper wall portion 13*a*; and a horizontal lower wall portion 13*c* projecting from a lower end portion of the side wall portion 13*b* outward in the railcar width direction. The lower wall portion 13*c* of the side ceiling plate bracket 13 is fixed to the side ceiling plate 12. The upper wall portion 13*a* of the side ceiling plate bracket 13 is fixed to the rotating body 11 from below. Specifically, by fastening nuts N1 and N2 to the lower end portion 10*c* of the supporting rod 10 from under the upper wall portion 13*a*, the side ceiling plate bracket 13 is fixed to the rotating body 11 (see FIGS. 3A and 3B). With this, the side ceiling plate bracket 13 is attached to the rotating body 11 so as to be positioned in the vertical direction. The rotating body 11 is provided such that when viewed from below, a part of the rotating body 11 protrudes from an end edge of the side ceiling plate bracket 13 in the horizontal direction. With this, a worker can rotate the rotating body 11 by hand from below, the rotating body 11 being located at an upper side of the side ceiling plate bracket 13.

Figure 4A:
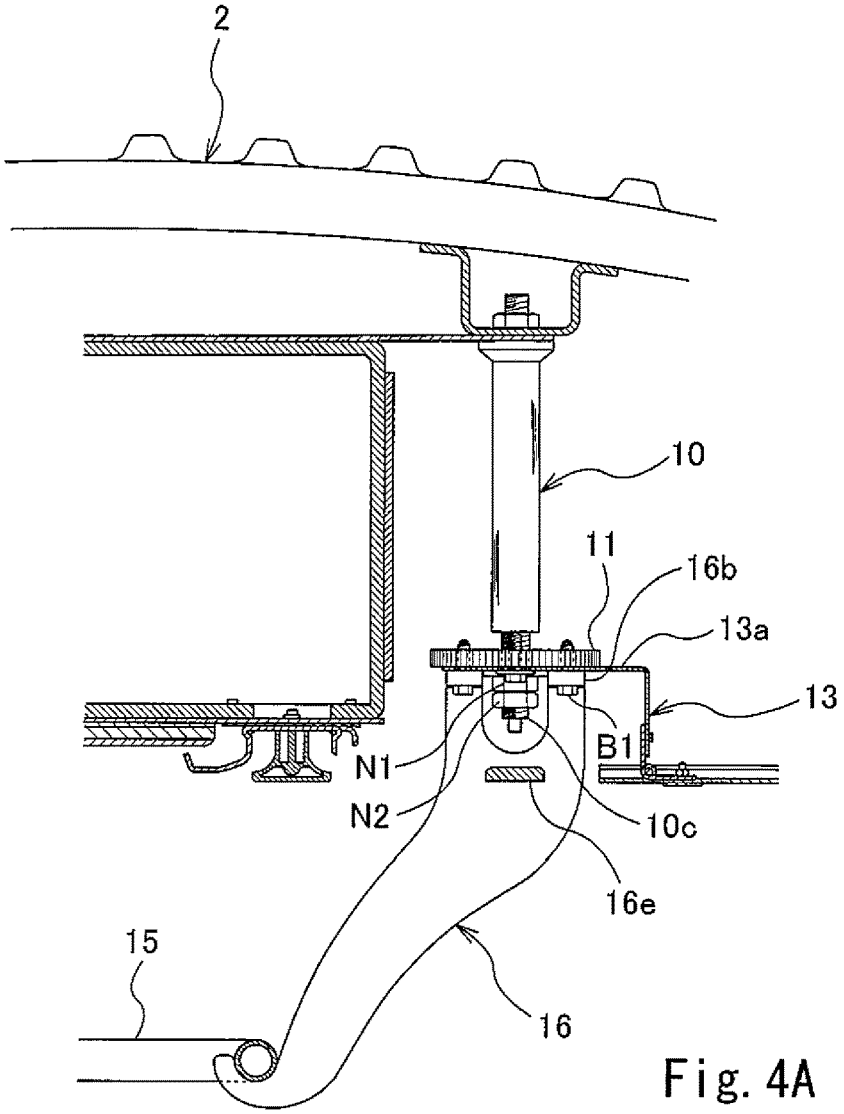
FIG. 4A is a major component sectional view for explaining assembling of the carbody shown in FIG. 1.
Figure 4B:
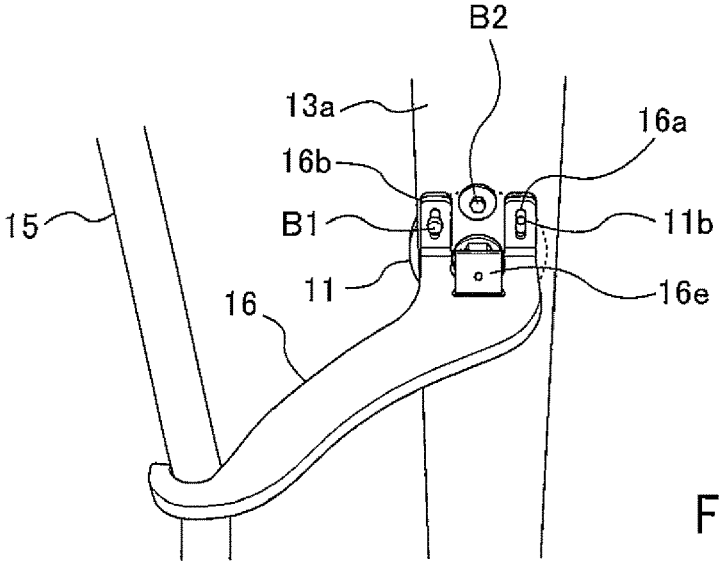
FIG. 4B is an enlarged perspective view showing a part of the carbody of FIG. 4A when viewed from below.

A grab rail bracket 16 (support target member) supporting a grab rail 15 to which a hanging strap 14 (strap) is attached is attached to the rotating body 11 (see FIGS. 4A and 4B). The grab rail bracket 16 is supported by the roof bodyshell 2 through the rotating body 11 and the supporting rod 10. The grab rail bracket 16 includes: a plurality of attaching portions 16*b* attached to the rotating body 11; a main body portion 16*c* extending downward from the attaching portions 16*b*; a hook portion 16*d* formed at a lower end portion of the main body portion 16*c*, the grab rail 15 being placed on the hook portion 16*d* from above; and a fixing portion 16*e* projecting from an intermediate portion of the main body portion 16*c* in the horizontal direction, a lighting base plate 17 being fixed to the fixing portion 16*e*.

Attachment holes 16*a* (see FIG. 4B) that are elongated holes each having a long axis extending in the railcar longitudinal direction are formed at the respective attaching portions 16*b* of the grab rail bracket 16. The plurality of (in the present embodiment, four) attaching portions 16*b* of the grab rail bracket 16 are connected to a region of the lower surface of the rotating body 11, the region being located around the axis of the supporting rod 10. Specifically, the attachment holes 16*a* of the plurality of attaching portions 16*b* are arranged at intervals on a virtual circle around the axis of the supporting rod 10. A plurality of attachment holes 11*b* (see FIG. 2B) each having an axis extending in the vertical direction are formed at the rotating body 11. The plurality of attachment holes 11*b* are arranged outside the middle internal thread hole 11*a* in a radial direction at intervals in a circumferential direction. Each of the attachment holes 11*b* is smaller in diameter than the middle internal thread hole 11*a*. Specifically, the plurality of attachment holes 11*b* are arranged at regular intervals on a virtual circle around the axis of the supporting rod 10. Internal threads are formed on inner peripheral surfaces of the attachment holes 11*b* of the rotating body 11. It should be noted that instead of forming the internal threads on the attachment holes 11*b*, nuts communicating with the respective attachment holes 11*b* may be fixed to an upper surface of the rotating body 11. In the present embodiment, the attachment holes 11*b* are eight attachment holes arranged on the virtual circle such that the adjacent attachment holes are spaced apart from each other by 45°. As described above, the rotating body 11 is adjustable in the vertical direction by rotating the rotating body 11 relative to the supporting rod 10. Therefore, the height of the grab rail bracket 16 can be adjusted with a higher degree of accuracy.

Below-described adjustment holes 13*aa*, 13*ab*, and 13*ac* (see FIG. 2B) are formed at the upper wall portion 13*a* of the side ceiling plate bracket 13. In a state where the upper wall portion 13*a* of the side ceiling plate bracket 13 is sandwiched between the attaching portion 16*b* of the grab rail bracket 16 and the rotating body 11, the attachment hole 16*a*, the adjustment hole 13*ab*, and the attachment hole 11*b* communicate with one another, and a fastening member B1 (for example, a bolt) is fastened to the attachment hole 11*b* through the attachment hole 16*a* and the adjustment hole 13*ab*. To be specific, the grab rail bracket 16 and the side ceiling plate bracket 13 are fastened together by the fastening member B1. With this, the grab rail bracket 16 is attached to the rotating body 11 so as to be positioned in the vertical direction.

A lighting device 18 (for example, a fluorescent light) is attached to the lighting base plate 17. The lighting base plate 17 is arranged so as to close a gap between the guide member 8 and the side ceiling plate 12 from below. Specifically, when viewed from below, the lighting base plate 17 overlaps an end portion of the guide member 8, the end portion being adjacent to a railcar width direction middle side of the lighting base plate 17, and also overlaps an end portion of the side ceiling plate 12, the end portion being adjacent to a railcar width direction outer side of the lighting base plate 17. A plurality of lighting base plates 17 are lined up in the railcar longitudinal direction, and each of the grab rail brackets 16 projects downward toward the passenger room from a boundary between the lighting base plates 17 adjacent to each other in the railcar longitudinal direction.

Figure 2A:
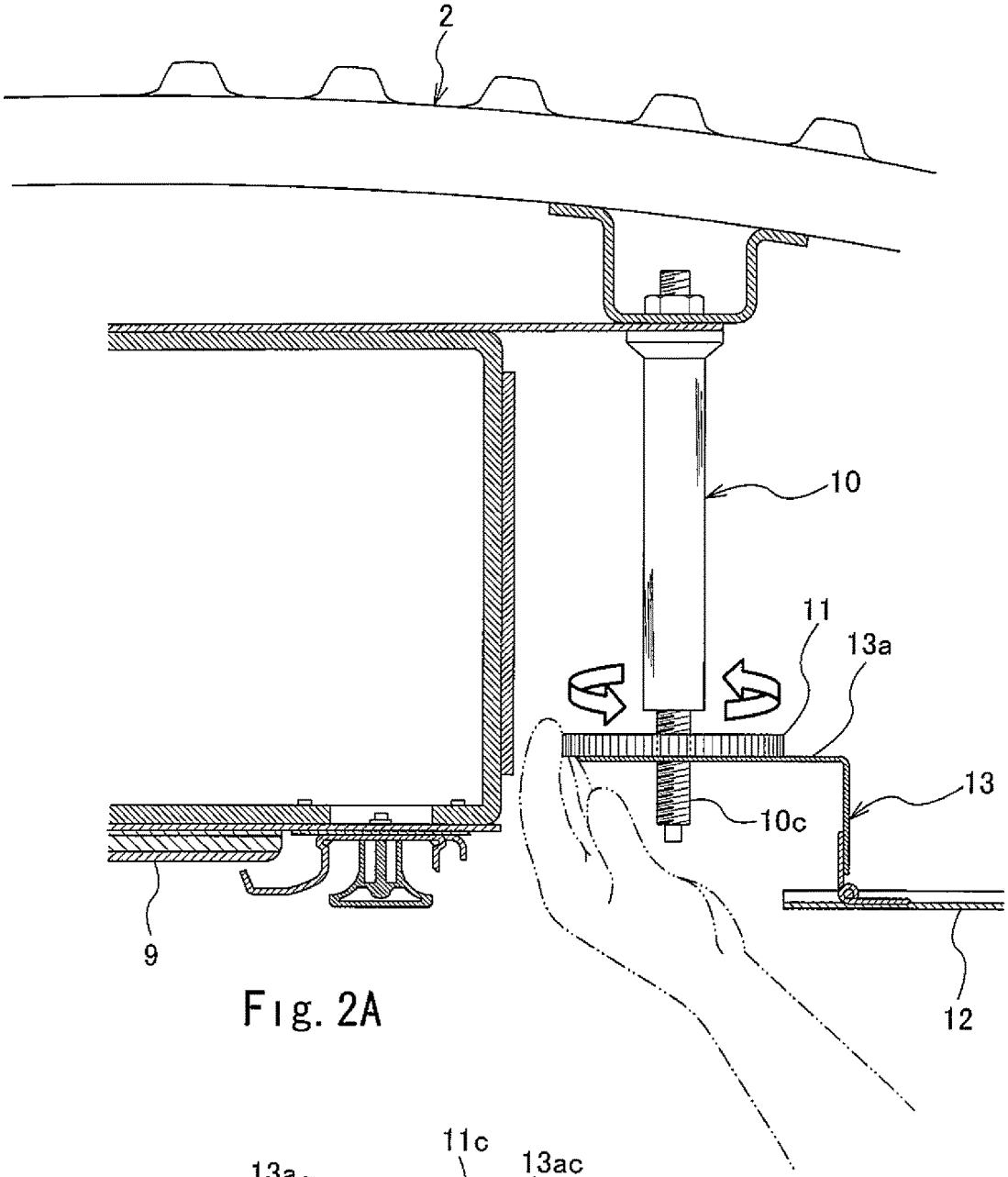
FIG. 2A is a major component sectional view for explaining assembling of the carbody shown in FIG. 1.
Figure 2B:
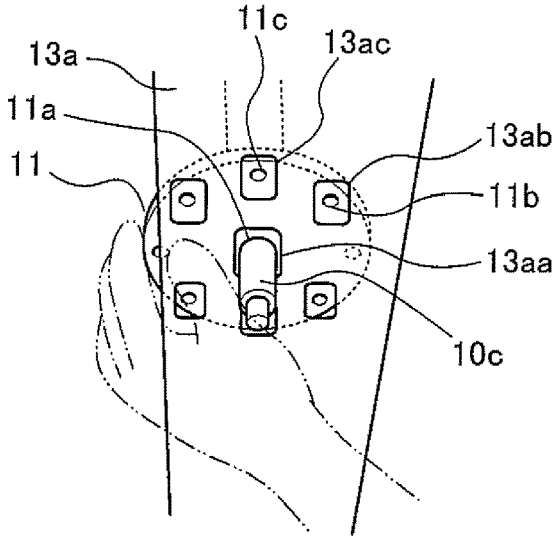
FIG. 2B is an enlarged perspective view showing a part of the carbody of FIG. 2A when viewed from below.

Next, a procedure of assembling the carbody 1 will be explained. FIGS. 2 to 4 are diagrams for explaining assembling of the carbody 1 shown in FIG. 1. As shown in FIGS. 2A and 2B, a first adjustment hole 13*aa*, second adjustment holes 13*ab*, and a third adjustment hole 13*ac* are formed at the upper wall portion 13*a* of the side ceiling plate bracket 13. The lower end portion 10*c* of the supporting rod 10 is inserted through the first adjustment hole 13*aa*. A diameter of the first adjustment hole 13*aa* is larger than an outer diameter of the lower end portion 10*c* of the supporting rod 10. A plurality of second adjustment holes 13*ab* are arranged outside the first adjustment hole 13*aa* in the radial direction at intervals in the circumferential direction. Each of the second adjustment holes 13*ab* is larger than the attachment hole 11*b* of the rotating body 11. Specifically, the plurality of second adjustment holes 13*ab* are arranged at regular intervals on a virtual circle around the axis of the supporting rod 10. A temporary fastening member B2 (for example, a bolt) is inserted through the third adjustment hole 13*ac*. The third adjustment hole 13*ac* is formed at such a position as to communicate with a temporary fastening hole 11*c* of the rotating body 11, the position being located in a region outside the first adjustment hole 13*aa* in the radial direction.

The lower end portion 10*c* of the supporting rod 10 is inserted through the first adjustment hole 13*aa* of the upper wall portion 13*a* of the ceiling plate bracket 13, and the upper wall portion 13*a* is brought into contact with the lower surface of the rotating body 11. Then, the vertical position of the rotating body 11 is adjusted so as to reduce the displacement between the vertical position of the lower surface of the side ceiling plate 12 and the vertical position of the lower surface of the middle ceiling plate 9. Specifically, by rotating the rotating body 11 relative to the supporting rod 10 by hand of a worker, the rotating body 11 is displaced relative to the supporting rod 10 in the vertical direction. With this, a vertical distance from each of the side ceiling plate bracket 13 and the side ceiling plate 12 to the roof bodyshell 2 is adjusted, and a vertical distance from each of the grab rail bracket 16 and the lighting base plate 17 to the roof bodyshell 2 is also adjusted, the grab rail bracket 16 and the lighting base plate 17 being attached after the side ceiling plate bracket 13 and the side ceiling plate 12 are attached.

Figure 3A:
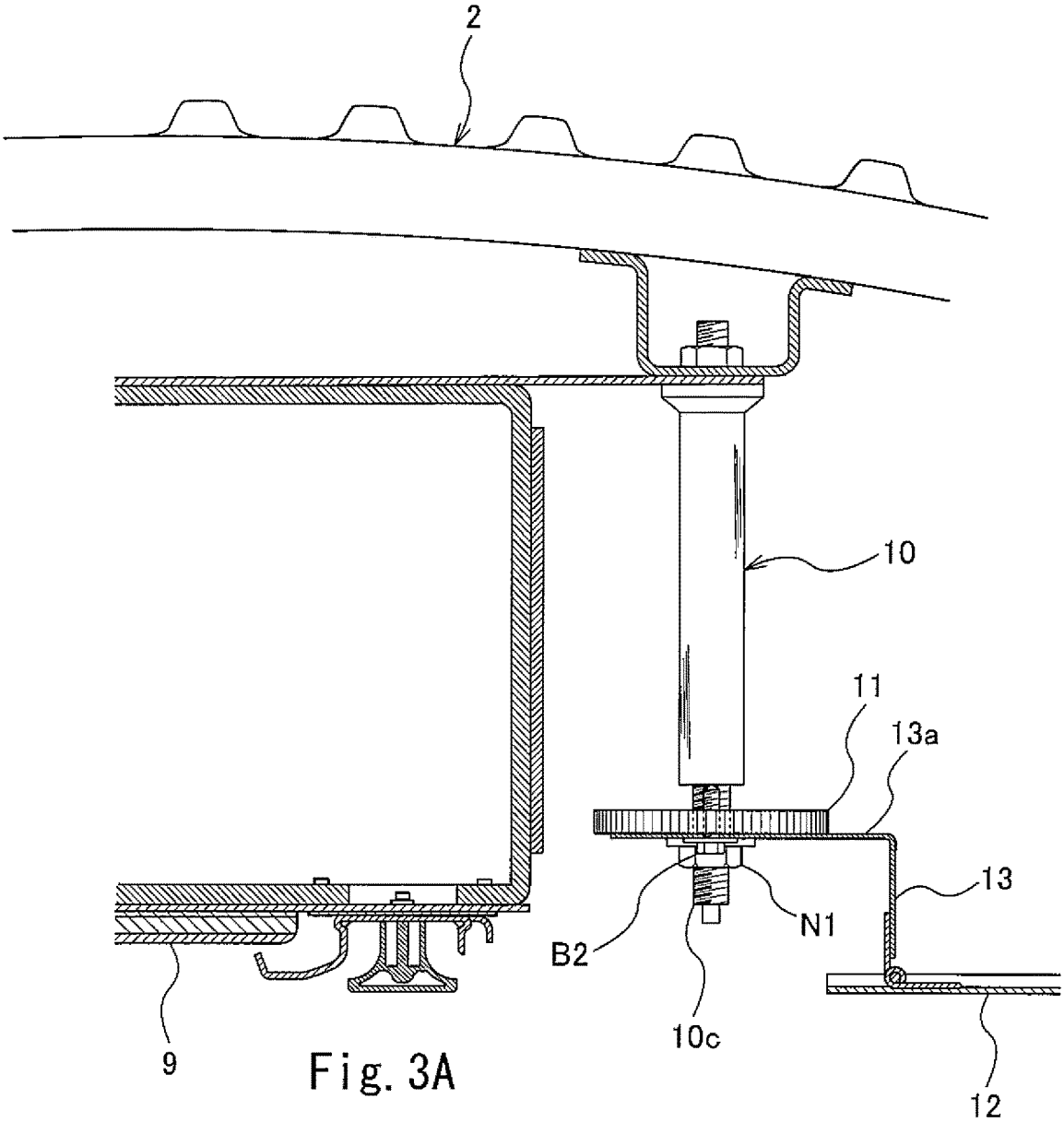
FIG. 3A is a major component sectional view for explaining assembling of the carbody shown in FIG. 1.
Figure 3B:
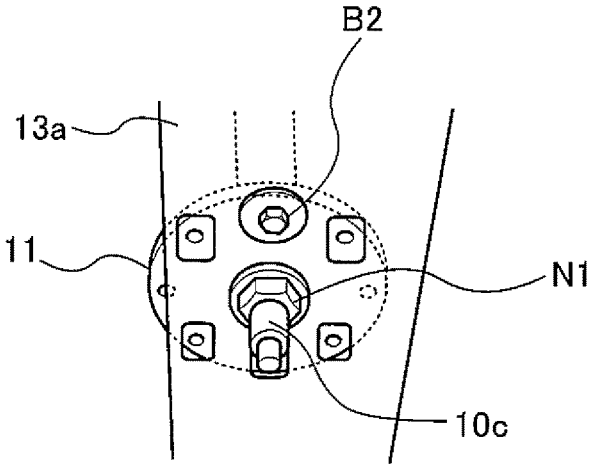
FIG. 3B is an enlarged perspective view showing a part of the carbody of FIG. 3A when viewed from below.

As shown in FIGS. 3A and 3B, after the above adjustment, the nut N1 is threadedly engaged with the lower end portion 10*c* of the supporting rod 10, and with this, the upper wall portion 13*a* of the side ceiling plate bracket 13 is sandwiched between the rotating body 11 and the nut N1. Thus, the side ceiling plate bracket 13 is attached to the rotating body 11 so as to be positioned in the vertical direction. For subsequent work, the temporary fastening member B2 is fastened to the temporary fastening hole 11*c* of the rotating body 11 through the third adjustment hole 13*ac*, and with this, the side ceiling plate bracket 13 is positioned relative to the rotating body 11 in the horizontal direction so as not to move relative to the rotating body 11.

As shown in FIGS. 4A and 4B, in a state where the attaching portion 16*b* of the grab rail bracket 16 is brought into contact with the lower surface of the upper wall portion 13*a* of the side ceiling plate bracket 13, and the attachment hole 16*a* of the attaching portion 16*b* communicates with the second adjustment hole 13*ab* of the side ceiling plate bracket 13 and the attachment hole 11*b* of the rotating body 11, the fastening member B1 is fastened to the attachment hole 11*b* through the attachment hole 16*a* and the second adjustment hole 13*ab*. To be specific, the grab rail bracket 16 is fastened to the rotating body 11 together with the side ceiling plate bracket 13 by the fastening member B1. As above, a plurality of fastening members B1 are arranged at regular intervals on a virtual circle around the axis of the supporting rod 10. As shown in FIG. 1, the lighting base plate 17 is attached to the fixing portion 16*e* of the grab rail bracket 16. Then, the grab rail 15 is supported by the hook portion 16*d* of the grab rail bracket 16.

According the above-explained configuration, the rotating body 11 is threadedly engaged with the supporting rod 10. Only by rotating the rotating body 11 relative to the supporting rod 10, the rotating body 11 can be displaced relative to the supporting rod 10 in the vertical direction. Therefore, the vertical distance from the support target member (the side ceiling plate bracket 13, the grab rail bracket 16, or the like) to the roof bodyshell 2 can be adjusted by such simple work. As long as the rotating body 11 is not rotated relative to the supporting rod 10, relative positions of the supporting rod 10 and the rotating body 11 in the vertical direction do not change. Therefore, the vertical distance between the roof bodyshell 2 and the support target member can be stably determined. Further, since the rotating body 11 is configured to be threadedly engaged with the supporting rod 10 so as to rotate relative to the supporting rod 10 around the axis extending in the vertical direction, strength with respect to load acting in the vertical direction is satisfactory.

Further, the support target members (the side ceiling plate bracket 13, the grab rail bracket 16, and the like) are fastened by the plurality of fastening members B1 to a region of the lower surface of the rotating body 11, the region being located around the axis of the supporting rod 10. Therefore, even when load in the vertical direction is applied to the support target member, the supporting rod 10 can stably receive the load along the axis. Thus, load resistance improves. Further, the first to third adjustment holes 13*aa*, 13*ab*, and 13*ac* are formed at the side ceiling plate bracket 13 and are larger than the lower end portion 10*c* of the supporting rod 10, and the attachment hole 11*b* and temporary fastening hole 11*c* of the rotating body 11. In a state where the second and third adjustment holes 13*ab* and 13*ac* communicate with the attachment hole 11*b* and the temporary fastening hole 11*c*, respectively, a horizontal position of the side ceiling plate bracket 13 relative to the rotating body 11 can be adjusted. Therefore, the position adjustment in both the vertical direction and the horizontal direction can be performed in the vicinity of the rotating body 11.

Embodiment 2

Figure 5:
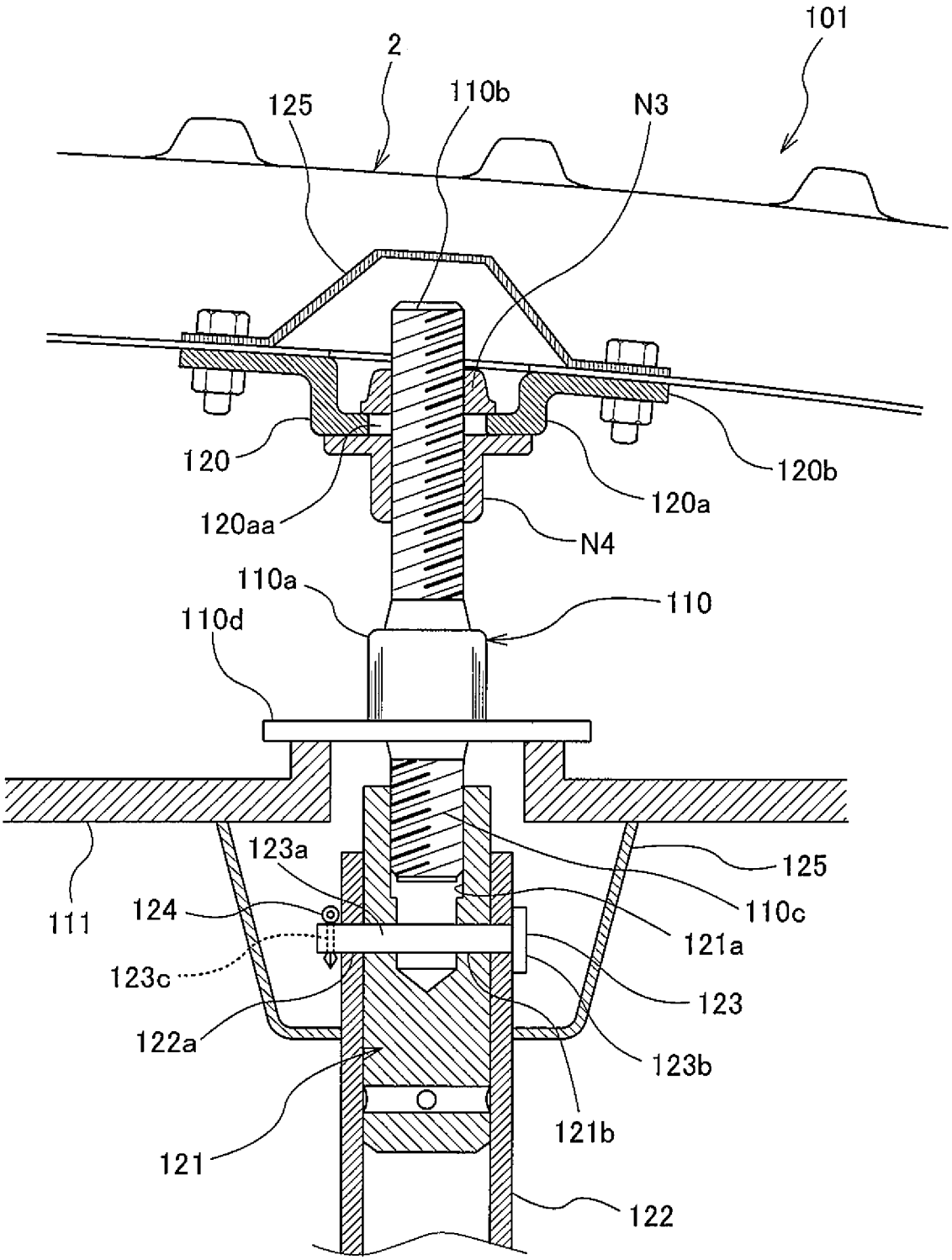
FIG. 5 is a major component sectional view showing the carbody of the railcar according to Embodiment 2.
Figure 6:
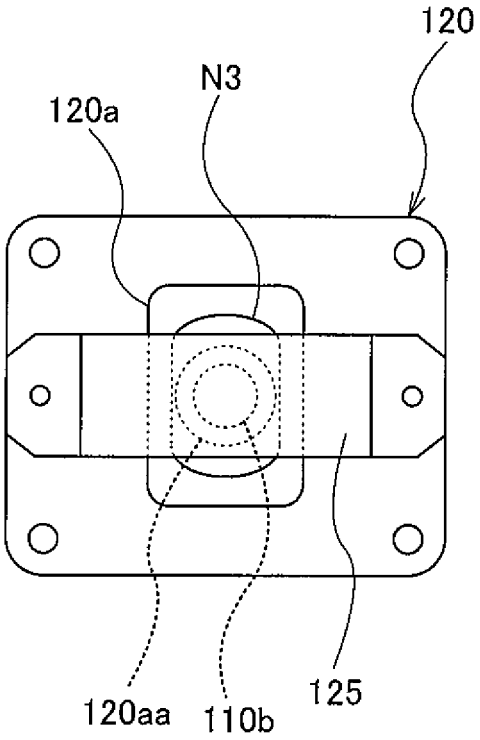
FIG. 6 is a plan view showing a part of the carbody shown in FIG. 5.

FIG. 5 is a major component sectional view showing a carbody 101 of the railcar according to Embodiment 2. FIG. 6 is a plan view showing major components of the carbody 101 shown in FIG. 5. As shown in FIGS. 5 and 6, a receiving tray member 120 is fixed to the roof bodyshell 2. The receiving tray member 120 includes: a recess 120*a* that is open upward; and a flange portion 120*b* horizontally projecting from an upper end edge of the recess 120*a*. The recess 120*a* is rectangular in plan view. A rectangular nut N3 (rotating body) is accommodated in the recess 120*a*. The nut N3 has such a size as to interfere with side surfaces of the recess 120*a* and therefore be not rotatable by a predetermined angle or more. A hole 120*aa* that is smaller than the nut N3 is formed at a bottom wall portion of the recess 120*a*, so that the nut N3 does not fall off.

A supporting rod 110 having an axis extending in the vertical direction is inserted through the hole 120*aa* of the receiving tray member 120. Specifically, the supporting rod 110 includes: a columnar rod main body portion 110*a*; an upper end portion 110*b* provided at an upper side of the rod main body portion 110*a*; a lower end portion 110*c* provided at a lower side of the rod main body portion 110*a*; and a flange portion 110*d* projecting from the main body portion 110*a* outward in the radial direction. The upper end portion 110*b* is an upper external thread portion that is smaller in diameter than the rod main body portion 110*a* and projects upward from the rod main body portion 110*a*. The lower end portion 110*c* is a lower external thread portion that is smaller in diameter than the rod main body portion 110*a* and projects downward from the rod main body portion 110*a*.

A nut N4 is threadedly engaged with an intermediate portion of the upper end portion 110*b* of the supporting rod 110. A part of the upper end portion 110*b* of the supporting rod 110 which part is located higher the nut N4 (rotating body) is inserted upward through the hole 120*aa* of the receiving tray member 120 to be fastened by the nut N3 from above. A cover 125 is attached to the receiving tray member 120 so as to cover the upper end portion 110*b* of the supporting rod 110 from above with a gap between the cover 125 and the upper end portion 110*b*. Since the upper end portion 110*b* of the supporting rod 110 is smaller in diameter than the hole 120*aa*, the position of the supporting rod 110 is adjustable in the horizontal direction. By sandwiching the receiving tray member 120 between the nuts N3 and N4, the nuts N3 and N4 and the supporting rod 110 are positioned relative to the receiving tray member 120 in the horizontal direction. To be specific, the nuts N3 and N4 (rotating bodies) and the supporting rod 110 are positioned relative to the roof bodyshell 2 in the vertical direction and the horizontal direction.

By rotating the supporting rod 110 relative to the nuts N3 and N4, the supporting rod 110 is displaced relative to the receiving tray member 120 in the vertical direction. To be specific, by rotating the supporting rod 110 relative to the nuts N3 and N4, the flange portion 110*d* of the supporting rod 110 can be displaced relative to the roof bodyshell 2 in the vertical direction. A ceiling plate 111 (support target member) is fixed to the flange portion 110*d* of the supporting rod 110. Therefore, by rotating the supporting rod 110 relative to the nuts N3 and N4, the vertical distance between the roof bodyshell 2 and the ceiling plate 111 can be adjusted.

An adapter 121 (rotating body) is threadedly engaged with the lower end portion 110*c* of the supporting rod 110. The adapter 121 has a columnar shape extending in the vertical direction. A recess 121*a* is formed on an upper end surface of the adapter 121, and internal threads are formed on an inner peripheral surface of the recess 121*a*. The lower end portion 110*c* of the supporting rod 110 is threadedly engaged with the recess 121*a*. By rotating the adapter 121 relative to the supporting rod 110, the adapter 121 is displaced relative to the supporting rod 110 in the vertical direction. A pin hole 121*b* is formed at the adapter 121 so as to penetrate the adapter 121 in the horizontal direction. A pipe 122 (support target member) is fitted to the adapter 121 from below. The pipe 122 is, for example, a bracket portion of the grab rail to which the hanging strap is attached.

A pin hole 122*a* is formed at the pipe 122 so as to penetrate the pipe 122 in the horizontal direction. A pin 123 is inserted through the pin hole 122*a* of the pipe 122 and the pin hole 121*b* of the adapter 121. The pin 123 includes: a shaft portion 123*a* on which threads are not formed; a head portion 123*b* formed at one end portion of the shaft portion 123*a*; and a through hole 123*c* formed at the other end portion of the shaft portion 123*a* and extending in a direction perpendicular to an axial direction, a retaining pin 124 being attached to the through hole 123*c*. The cover 125 is attached to an upper end portion of the pipe 122 so as to cover the pin 123 and the adapter 121.

According to the above-explained configuration, only by rotating the supporting rod 110 relative to the nuts N3 and N4, the supporting rod 110 can be displaced relative to the roof bodyshell 2 in the vertical direction. Therefore, the vertical distance from the ceiling plate 111 to the roof bodyshell 2 can be adjusted by such simple work. Further, only by rotating the adapter 121 relative to the supporting rod 110, the adapter 121 can be displaced relative to the ceiling plate 111 and the roof bodyshell 2 in the vertical direction. Therefore, the vertical distance from the adapter 121 to the ceiling plate 111 can be adjusted by such simple work. To be specific, the vertical distance from the ceiling plate 111 (first support target member) to the roof bodyshell 2 and the vertical distance from the pipe 122 (second support target member) to the ceiling plate 111 (first support target member) can be individually adjusted on the same axis while using the supporting rod 110.

Embodiment 3

Figure 7:
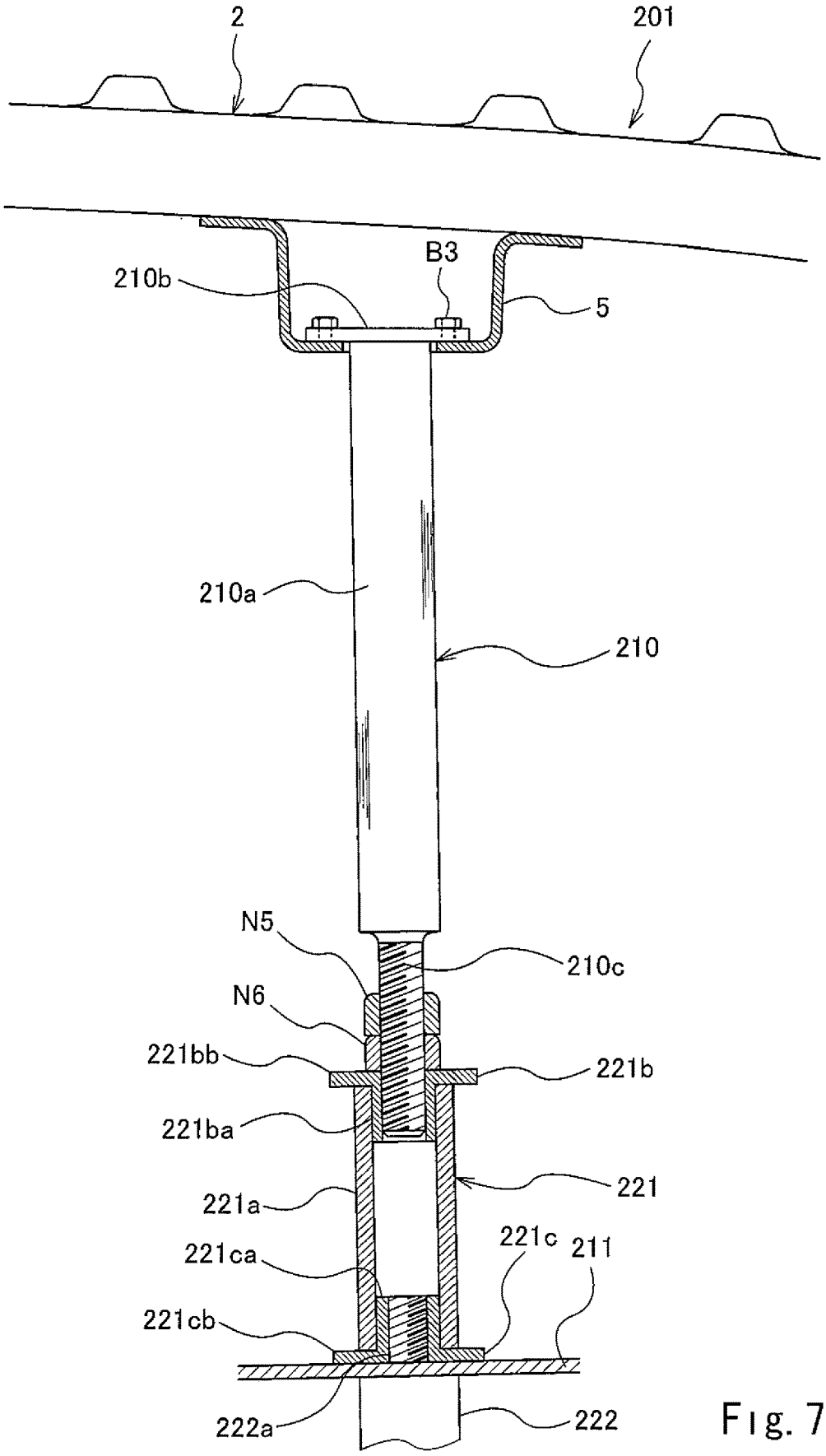
FIG. 7 is a major component sectional view showing the carbody of the railcar according to Embodiment 3.

FIG. 7 is a major component sectional view showing a carbody 201 of a railcar according to Embodiment 3. As shown in FIG. 7, the first reinforcing member 5 extending in the railcar longitudinal direction is fixed to the lower surface of the roof bodyshell 2, and a supporting rod 210 having an axis extending in the vertical direction is fixed to the first reinforcing member 5. The supporting rod 210 includes: a columnar rod main body portion 210*a*; a flange portion 210*b* projecting from an upper end of the rod main body portion 210*a* in the horizontal direction; and a lower end portion 210*c* provided at a lower side of the rod main body portion 210*a*. The lower end portion 210*c* is an external thread portion that is smaller in diameter than the rod main body portion 210*a* and projecting downward from the rod main body portion 210*a*.

The flange portion 210*b* of the supporting rod 210 is fixed to the first reinforcing member 5 by fastening members B3 (for example, bolts). The first reinforcing member 5 is provided with elongated holes into which the fastening members B3 are inserted, and the position of the supporting rod 210 is adjustable in the railcar longitudinal direction. An adapter 221 (rotating body) is threadedly engaged with the lower end portion 210*c* of the supporting rod 210. The adapter 221 has a cylindrical shape extending in the vertical direction, and internal threads are formed on upper and low inner peripheral surfaces of the adapter 221. Specifically, the adapter 221 includes: a cylindrical portion 221*a*; an upper screw seat portion 221*b* fitted to and connected to the cylindrical portion 221*a* from above, internal threads being formed on an inner peripheral surface of the upper screw seat portion 221*b*; and a lower screw seat portion 221*c* fitted to and connected to the cylindrical portion 221*a* from below, internal threads being formed on an inner peripheral surface of the lower screw seat portion 221*c*. The upper screw seat portion 221*b* includes: a tubular portion 221*ba* fitted to the cylindrical portion 221*a* from above; and a flange portion 221*bb* projecting from an upper end of the tubular portion 221*ba* in the horizontal direction. The lower screw seat portion 221*c* includes: a tubular portion 221*ca* fitted to the cylindrical portion 221*a* from below; and a flange portion 221*cb* projecting from a lower end of the tubular portion 221*ca* in the horizontal direction.

Two nuts N5 and N6 are threadedly engaged with the lower end portion 210*c* of the supporting rod 210, and the upper screw seat portion 221*b* of the adapter 221 is threadedly engaged with a part of the lower end portion 210*c*, the part being located lower than the nuts N5 and N6. By rotating the adapter 221 relative to the supporting rod 210, the adapter 221 is displaced relative to the supporting rod 210 in the vertical direction. In a state where the vertical position of the adapter 221 is determined, the nuts N5 and N6 are tightened with respect to the adapter 221. An external thread portion 222*a* of a bracket portion 222 of the grab rail is threadedly engaged with the lower screw seat portion 221*c* of the adapter 221 through a ceiling plate 211 from below. To be specific, by sandwiching the ceiling plate 211 between the bracket portion 222 and the adapter 221, both the bracket portion 222 and the ceiling plate 211 are attached to the adapter 221. The ceiling plate 211 is provided with an elongated hole extending in the railcar width direction (sleeper direction), and the position of the bracket portion 222 in the railcar width direction is adjustable.

According to the above-explained configuration, only by rotating the adapter 221 relative to the supporting rod 210, the adapter 221 can be displaced relative to the roof bodyshell 2 in the vertical direction. Therefore, the vertical distance from each of the ceiling plate 211 and the bracket portion 222 to the roof bodyshell 2 can be adjusted by such simple work.

The present invention is not limited to the above embodiments, and modifications, additions, and eliminations of components may be made within the scope of the present invention. The above embodiments may be combined arbitrarily. For example, a part of components or methods in one embodiment may be applied to another embodiment. The supporting rod may be not solid but hollow. The supporting rod may not have a circular cross section. Instead of the supporting rod, a supporting body not having a rod shape may be used. Instead of a bolt, other fixtures such as a rivet may be used as the fastening member. The support target member may be an interior display device, a baggage holder device, a stanchion pole, or the like in addition to the above.

REFERENCE SIGNS LIST

1, 101, 201 carbody
2 roof bodyshell
10, 110, 210 supporting rod
11 rotating body
13 side ceiling plate bracket (support target member)
13*aa* first adjustment hole
13*ab* second adjustment hole
16 grab rail bracket (support target member)
111, 211 ceiling plate (support target member)

121, 221 adapter (rotating body)
122 pipe (support target member)
N3, N4 nut (rotating body)

The invention claimed is:

1. A carbody of a railcar, the carbody comprising:

a roof bodyshell;

a supporting rod provided under the roof bodyshell, the supporting rod having an axis extending in a vertical direction and being attached to the roof bodyshell in a state of being positioned in the vertical direction;

a rotating body which is threadedly engaged with the supporting rod and rotates relative to the supporting rod about an axis extending in the vertical direction to be displaced relative to the supporting rod in the vertical direction; and a support target member supported by the roof bodyshell through the supporting rod and the rotating body, the support target member being attached to the rotating body in a state of being positioned in the vertical direction, a vertical distance between the roof bodyshell and the support target member being adjustable by displacement of the rotating body relative to the supporting rod, an upper external thread portion being formed at an upper end portion of the supporting rod, a lower external thread portion being formed at a lower end portion of the supporting rod, the upper end portion of the supporting rod being threadedly engaged with the roof bodyshell, the rotating body being threadedly engaged with the lower end portion of the supporting rod to be rotatable relative to the lower end portion of the supporting rod about the axis; and the support target member being connected to a region of a lower surface of the rotating body, the region being located around the axis.

2. The carbody according to claim 1, wherein:

an attachment hole having an axis extending in the vertical direction is formed at the rotating body;

an adjustment hole is formed at the support target member, the adjustment hole communicating with the attachment hole and being larger than the attachment hole; and the support target member is fastened to the rotating body by attaching a fastening member to the attachment hole through the adjustment hole.

3. The carbody according to claim 1, wherein:

a plurality of attachment holes are formed at the rotating body, the attachment holes being arranged on a virtual circle around the axis of the supporting rod.

4. A carbody of a railcar, the carbody comprising:

a roof bodyshell;

a supporting rod provided under the roof bodyshell;

a rotating body which is threadedly engaged with the supporting rod and rotates relative to the supporting rod about an axis extending in a vertical direction to be displaced relative to the supporting rod in the vertical direction, the rotating body being attached to the roof body shell in a state of being positioned in the vertical direction; and a support target member supported by the roof bodyshell through the supporting rod and the rotating body, the support target member being attached to the supporting rod in a state of being positioned in the vertical direction, a vertical distance between the roof bodyshell and the support target member being adjustable by displacement of the supporting rod relative to the rotating body and the roof bodyshell.

* * * * *